United States Patent [19]

Morrison

[11] Patent Number: 4,778,408

[45] Date of Patent: Oct. 18, 1988

[54] BATTERY TERMINAL CONNECTOR

[76] Inventor: Charles A. Morrison, P.O. Box 5492, Hyperama, Weltevreden Park, 1710, Transvaal Province, South Africa

[21] Appl. No.: 14,089

[22] Filed: Jan. 27, 1987

Related U.S. Application Data

[63] Continuation of Ser. No. 785,540, Oct. 8, 1985, abandoned.

[30] Foreign Application Priority Data

Feb. 4, 1985 [ZA] South Africa ..... 85/0831

[51] Int. Cl.[4] ..... H01R 11/22

[52] U.S. Cl. ..... 439/522; 439/759

[58] Field of Search ..... 339/116 R, 228, 116 C, 339/224, 225, 227, 229, 240, 254 R, 256 S, 238, 240; 439/202, 522, 759

[56] References Cited

U.S. PATENT DOCUMENTS

| | | | |
|---|---|---|---|
| 1,722,203 | 7/1929 | Day | 439/202 |
| 2,098,091 | 11/1937 | Gamble | 439/202 |
| 2,168,250 | 8/1939 | Toiberg et al. | 439/522 |
| 2,657,370 | 10/1953 | Hobson | 439/726 |
| 2,820,208 | 1/1958 | Howells | 439/202 |
| 2,906,988 | 9/1959 | Stocking | 439/522 |
| 3,521,223 | 7/1970 | Martinez | 439/726 |
| 3,662,322 | 5/1972 | Morrison | 439/388 |
| 4,012,104 | 3/1977 | Wening | 439/522 |
| 4,342,497 | 8/1982 | Morrison | 439/759 |

FOREIGN PATENT DOCUMENTS

| | | | |
|---|---|---|---|
| 2824463 | 1/1979 | Fed. Rep. of Germany | 339/116 R |

*Primary Examiner*—Neil Abrams

*Attorney, Agent, or Firm*—Stevens, Davis, Miller & Mosher

[57] ABSTRACT

The invention provides a battery terminal connector of the type having an elongate electrically insultaing body housing a battery terminal post engaging connector block electrically connected to an electrical cable, axially movable within the body, and urged by means of spring biasing means, in use, into contact with a battery terminal post received in a socket provided in the body. The body of the battery terminal connector is further provided with an integrally formed, inwardly directed flange for holding the spring within the body such that it bears against both the connector block and flange. Further, the body has an access opening for introducing the connector block, electrical cable, and spring therein in a substantially lateral direction.

5 Claims, 2 Drawing Sheets

BATTERY TERMINAL CONNECTOR

This application is a continuation of application Ser. No. 785,540, filed 10, 8, 1985, and now abandoned.

FIELD OF THE INVENTION

THIS INVENTION relates to battery terminal connectors of the type having a hollow elongate electrically insulating body which has an axially transverse aperture or socket shape to receive a battery terminal post in use.

BACKGROUND TO THE INVENTION

In this type of battery terminal connector, the elongate insulating body houses a longitudinally movable connector block which is adapted to be urged into contact, transversely, with a battery terminal post projecting through the transverse aperture or located in the socket, using some biasing means. Where the biasing means is a spring, for example, a helical spring, an inwardly directed bearing flange is conveniently provided at the end of the elongate insulating body remote from the socket, to retain the spring while permitting an electrical cable which is connected to the connector block to pass through the flange and spring.

In South African Pat. No. 80/0794, and its equivalent U.S. Pat. No. 4342,497, such a flange is provided by means of a closure member which co-operates with the elongate insulating body of the battery terminal connector by means of a bayonet and socket type of arrangement. This type of closure permits easy assembly of the battery terminal connector components, and conveniently permits it to be sold in kit form. Unfortunately, the closure has the disadvantage of becoming loose, thereby relaxing the spring, and effectively breaking the firm electrical contact between the connector block and the battery terminal post. It is envisaged that the same may occur with a screw threaded type of closure such as is described in British Patent No. 972,740 due to slip of worn threads or loosening of the screw threaded closure member due to vibrations and the like.

The object of this invention is to provide a battery terminal connector of the above general type wherein the body housing the connector block ensures that a more reliable electrical contact is maintained between the connector block and a battery terminal post received in the connector socket while still providing the advantage that the battery terminal connector components may be easily assembled for manufacture or for sale in kit form.

SUMMARY OF THE INVENTION

In accordance with this invention there is provided a battery terminal connector comprising an elongate hollow body made from electrically insulating material having a transversely extending socket or aperture located towards one end thereof and adapted, in use, to receive a battery terminal post, the body further defining a passage extending along the length of the body in a direction which is transverse to the aperture or socket, an electrically conductive battery post engaging connector block movable longitudinally within the passage and adapted to be connected to an electrical cable for use, and a spring for biasing the connector block in operation, towards co-operation with a battery terminal post received through the aperture or within the socket; the body being characterized in that its end region remote from the socket has an inwardly directed flange integrally formed therewith for holding the spring within the body such that it bears against the flange and the connector block, and in that at least one access opening is provided between the socket and the flange whereby the connector block together with any associated electrical cable and spring may be introduced into the passage in a substantially lateral direction.

A further feature of the invention provides for there to be one or more access openings to expose at least a portion of the surface of the connector block while operatively in engagement with a battery terminal post and preferably to expose the sides of the connector block so that auxilliary electrical connections may be made thereto, for example, by an auxilliary crocodile type of clamp.

A still further feature of the invention provides for each access opening to be covered by a closure in order to substantially exclude foreign matter and moisture from the interior of the battery terminal connector. Conveniently, a single cover member may be provided for all access openings. Such a cover member may be hingedly attached to the body or may be removable therefrom and is preferably also made from electrically insulating material. A cover to an access opening may also be provided in sections in order to selectively expose portions of the interior of the connector.

Still another feature of the invention provides for the body to be of injection moulded plastics material.

In accordance with a preferred embodiment of the battery terminal connector according to this invention, the elongate hollow body has a rectangular cross-section along a substantial part of its length, and a first substantially rectangular access opening for laterally introducing the connector block, electrical cable, and spring, a cover for this aperture defining an operatively upper wall of the insulating body and thus the operatively upper surface of the battery terminal connector. A circular aperture is provided in the operatively lower wall to define the socket entrance, and two further access openings are provided in the side panels extending between the operatively lower and upper panels to expose parts of the sides of the connector block, the cover therefor being integral with the cover to the first access opening so as to define a single cover member which is hingedly attached to the insulating body at the end which is remote from the flange.

BRIEF DESCRIPTION OF THE DRAWINGS

In order that the invention may be better understood two embodiments thereof will be described with reference to the accompanying drawings.

DETAILED DESCRIPTION WITH REFERENCE TO THE DRAWINGS

Figure 1:
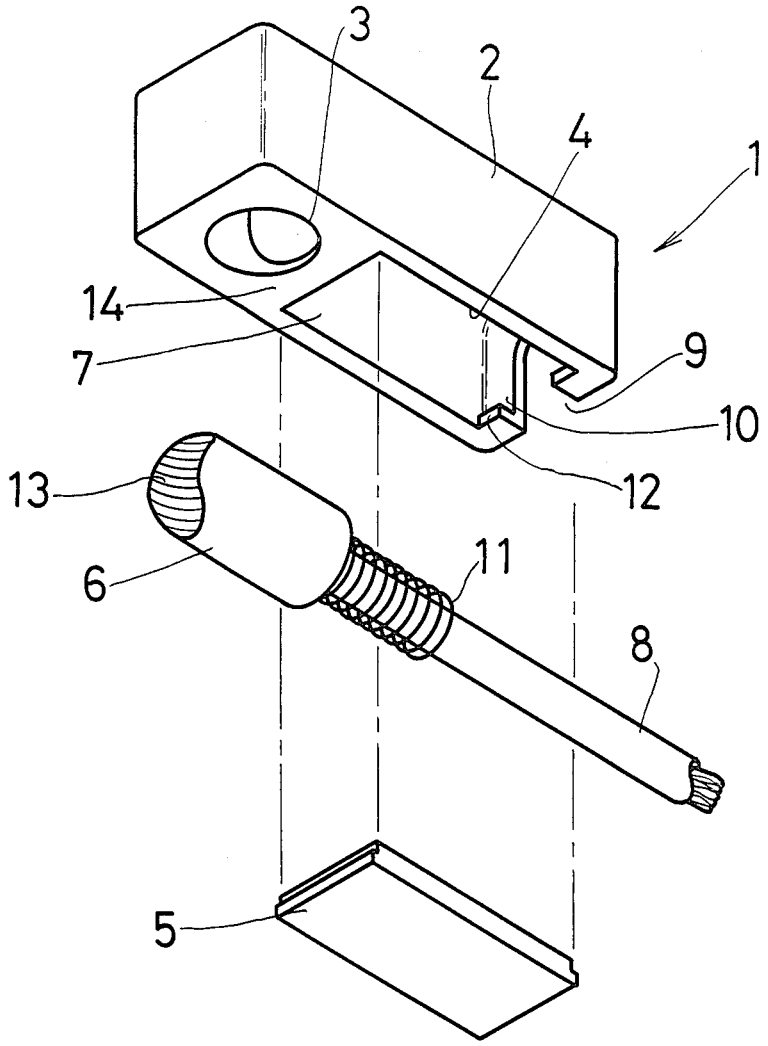
FIG. 1 is an exploded view of one form of battery terminal connector according to the invention.

In the embodiment of the invention illustrated in FIG. 1 a battery terminal connector (generaly indicated by numeral 1) includes an elongate hollow plastics body 2 of rectangular shape in cross-section and having at one end thereof, a transverse socket 3, having a circular opening in one panel of the connector body and adapted to receive a battery terminal post therein. An access opening 4 which is rectangular in shape, is provided in the same panel and is provided with a removable cover 5 of corresponding shape.

terminal post therein. An access opening 4 which is rectangular in shape, is provided in the same panel and is provided with a removable cover 5 of corresponding shape.

In the open configuration, with the cover 5 to the access opening 4 removed, a battery terminal post engaging connector block 6, which lies in a passage 7 inside the body 2, is partly exposed. The connector block 6 is, for use, electrically connected to an electrical cable 8 by means of a socket and set screw arrangement, for example, or by any other means such as soldering, brazing or the like. The connector block 6 may be made of part-circular cross-section, as illustrated, or may be of rectangular or hexagonal cross-section.

In the assembled condition, the electrical cable 8 emerges from the end of the body 2 which is remote from the socket 3 through a U-shaped opening 9 in an inwardly directed retaining flange 10. A helical spring 11 through which the cable 8 passes, and which is used to bias the terminal post engaging connector block 6 towards a battery terminal post located in the socket 3 when in use, is retained inside the connector body 2 by bearing on the block 6 and the flange 10 as well as by means of lips 12 located on the flange 10.

In use, the helical spring 11 is axially compressed and exerts a force on the connector block 6 to urge it into firm contact with a battery terminal post.

A serrated, curved surface is provided on the contact face 13 of the connector block 6 to ensure that a proper electrical contact is established between the connector block 6 and a battery terminal post.

To assemble the above described battery terminal connector the connector block 6 having already been attached to the electrical cable 8, is introduced through the access opening 4 into the passage 7 of the body 2. The connector block 6 is retained in the passage 7 by a bridging member 14 integral with the body 2 which lies between the socket 3 and the access opening 4.

The coil spring 11 which is already mounted on the cable 8 is then compressed against the connector block 6, and the portion of the electrical cable 8 opposite the connector block 6 is laterally inserted into the U-shaped opening 9 of the end panel 10 of the body 2. Thereafter, the coil spring 11 is released. The cover 5 is then placed over the opening 4 to keep out foreign matter.

The cover 5 may be hingedly attached to the body 2 but may also be a separate piece (as illustrated). Alternatively, it may assume the form of pieces which correspond to the shape of the access opening and which are provided with suitable clip formations to enable them to be snapped into their operative position. The cover may also be provided with recesses which, in use, enable a coin to be used to pry the cover off or alternatively, the cover may be provided with tabs to facilitate the removal thereof.

Figure 2:
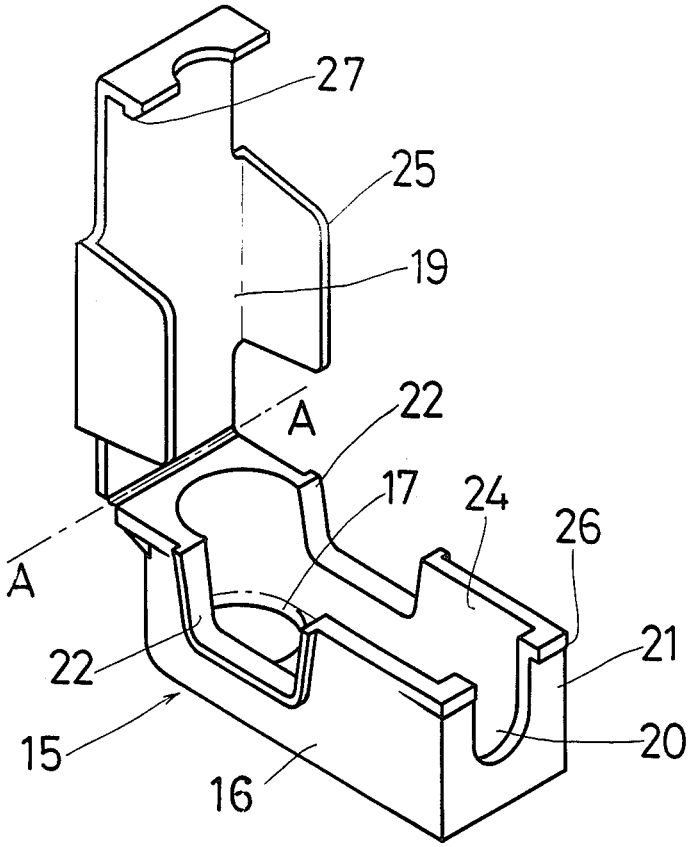
FIG. 2 is a perspective view of the tubular insulating body of another form of battery terminal connector according to this invention; and, FIG. 3 is a longitudinal sectional view of a battery terminal connector having the tubular insulating body of FIG. 2, and operatively located in a battery terminal post.
Figure 3:
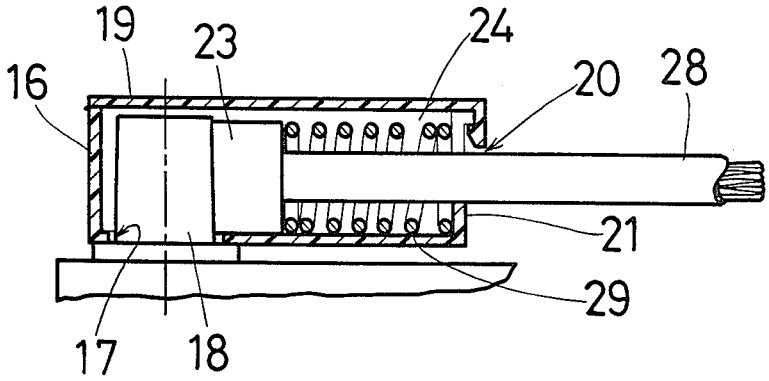

A second battery terminal connector according to this invention is illustrated in FIGS. 2 and 3 and is generally indicated by numeral 15. This connector also includes an elongate hollow plastics body 16 of rectangular cross-section having at one end thereof an axially transverse socket 17 which is defined by a circular opening in one panel of the body 16 and which is adapted to receive a battery terminal post 18 therein.

Lateral access to the interior of the battery terminal connector 15 is provided by omitting the operatively upper wall of the body and a cover member 19 is provided which defines the panel of the body 16 in the closed condition. This panel thus defines the operatively upper surface of the battery terminal connector, while the socket 17 is provided in the operatively lower panel of the connector 15. The cover member 19 is hingedly attached to the body 16 at the end nearest to the socket 17 along the line indicated by line "A—A" by a flexible integral web of plastics material.

Similarly to the battery terminal connector illustrated in FIG. 1, the end of the body 16 remote from the socket 17 is provided with a U-shaped opening 20 in a retaining flange defining an integral end panel 21.

The panels of the body 16 which extend between the operatively lower and upper panels of the connector 15 are each provided with a rectangular-shaped opening 22 communicating with the upper access opening and which define opposed regions for effecting contact with a battery post engaging connector block 23 located in a passage 24 provided in the connector 15. The cover member 19 includes integrally moulded flaps 25 to provide covers for the openings 22 when the cover member 19 is in its operatively closed position.

It will be noted that the operatively upper end of the flange defining the integral flange 21 is provided with clip formations 26 which are adapted to co-operate with suitably shaped projections or catches 27 provided on the cover member 19 to firmly hold the cover in the closed position thereof.

It will be understood that the cover member 19 may be released thereby exposing the battery post engaging connector block 23 so that it may be coupled to an auxilliary electrical connection. This may conveniently be accomplished by a crocodile clamp or other suitable electrical connector.

It will further be understood that the battery terminal connector 15, when ready for use, also includes an electrical cable 28 and a coil spring 29 as described above (see FIG. 3). An important feature of this invention is the access opening provided in the connector body for introducing the connector block, electrical cable and spring biasing means therein in a substantially lateral direction thereby permitting the body to be closed at both ends by panels integral therewith such that a reliable bearing surface for the spring is provided and thus electrical contact is maintained.

Many variations may be made to the above described embodiments of the invention without departing from the scope hereof. In particular, the configuration of the insulating body may vary considerably, as well as the number and nature of access openings.

What is claimed is:

1. A battery terminal connector comprising an elongate hollow body made from electrically insulating material and having a transversely extending socket located towards one end thereof and adapted, in use, to receive a battery terminal post, the body having a passage extending along the length of the body in a direction transverse to the socket; an electrically conductive battery post engaging connector block movable longitudinally within the passage and adapted to be operatively connected to an electrical cable, and a spring for biasing the connector block in operation for movement towards engagement with a battery terminal post operatively received within the socket; the body in its end region remote from the socket having a flange integrally formed therewith for holding the spring within the body such that the spring bears against the flange and the connector block, and at least one longitudinally extending access opening between the socket and the flange whereby the connector block together with an operatively associated electrical cable and spring may be introduced into the passage in a substantially lateral direction, said body having openings in addition to said access opening and a single cover member provided to cover said access opening and having flap means to cover said additional openings.

2. A battery terminal connector according to claim 1 wherein said single cover is hingedly attached to the body.

3. A battery terminal conductor according to claim 1 wherein the body is of an injection moulded plastics material.

4. A battery terminal connector comprising an elongate hollow body made from electrically insulating material and having a transversely extending socket located towards one end thereof and adapted, in use, to receive a battery terminal post, the body having a passage extending along the length of the body in a direction transverse to the socket; an electrically conductive battery post engaging connector block movable longitudinally within the passage and adapted to be operatively connected to an electrical cable, and a spring for biasing the connector block in operation for movement towards engagement with a battery terminal post operatively received within the socket; the body in its end region remote from the socket having a flange integrally formed therewith for holding the spring within the body such that the spring bears against the flange and the connector block, said passage between the socket and the flange being positioned so that the connector block together with an operatively associated electrical cable and spring may be introduced through an access opening into the passage in a substantially lateral direction, the elongate hollow body having a rectangular cross section along a substantial part of its length, such cross-section being defined by an upper panel, a lower panel, and a pair of opposite side panels, the lower panel having an entrance to the socket and wherein the access opening is of substantially rectangular shape, said upper panel being a cover for such access opening, and two additional openings one of which is formed in each of the side panels of the body, such additional openings being positioned to expose parts of opposite surfaces of the connector block; cover flaps formed integral with said cover for said additional openings such that the cover flaps and cover form a single cover member, such cover member being hingedly attached to the insulating body at the end thereof at which the socket is located.

5. A battery terminal connector according to claim 4 wherein the body is of injection molded plastic material.

* * * * *